US009965996B2

(12) United States Patent
Lee et al.

(10) Patent No.: US 9,965,996 B2
(45) Date of Patent: May 8, 2018

(54) TIMING CONTROLLER AND DISPLAY APPARATUS HAVING THE SAME

(71) Applicant: SAMSUNG DISPLAY CO., LTD., Yongin-si, Gyeonggi-Do (KR)

(72) Inventors: Dong-Gyu Lee, Seoul (KR); Geun Jeong Park, Daegu (KR); Ah-Reum Kim, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 56 days.

(21) Appl. No.: 15/084,768

(22) Filed: Mar. 30, 2016

(65) Prior Publication Data

US 2017/0092185 A1 Mar. 30, 2017

(30) Foreign Application Priority Data

Sep. 30, 2015 (KR) ..... 10-2015-0137630

(51) Int. Cl.
*G09G 3/20* (2006.01)

(52) U.S. Cl.
CPC ..... *G09G 3/2092* (2013.01); *G09G 2310/08* (2013.01); *G09G 2320/0257* (2013.01)

(58) Field of Classification Search
None
See application file for complete search history.

(56) References Cited

U.S. PATENT DOCUMENTS

2011/0222559 A1* 9/2011 Ishii ..... G09G 3/003 370/498
2011/0227961 A1* 9/2011 Kikuta ..... G09G 3/3225 345/690
2013/0106876 A1* 5/2013 Lee ..... G06F 13/14 345/520
2015/0279295 A1* 10/2015 Shikata ..... G09G 3/3607 345/694

FOREIGN PATENT DOCUMENTS

KR 1020040073863 8/2004
KR 1020150042464 4/2015

* cited by examiner

*Primary Examiner* — Joseph Haley
(74) *Attorney, Agent, or Firm* — F. Chau & Associates, LLC

(57) ABSTRACT

A timing controller includes an image determining part configured to determine whether an input image is a static image based on input image data, a signal controller configured to shift a timing of a first data enable signal to generate a second data enable signal when the input image is the static image, and a signal generator configured to generate control signals based on the second data enable signal.

20 Claims, 13 Drawing Sheets

TIMING CONTROLLER AND DISPLAY APPARATUS HAVING THE SAME

CROSS-REFERENCE TO RELATED APPLICATION

This application claims priority under 35 U.S.C. § 119 to Korean Patent Application No. 10-2015-0137630, filed on Sep. 30, 2015 in the Korean Intellectual Property Office (KIPO), the disclosure of which is incorporated by reference in its entirety herein.

BACKGROUND

1. Technical Field

Exemplary embodiments of the present inventive concept relate generally to display devices, and more particularly to timing controllers and display apparatuses including the timing controllers.

2. Discussion of Related Art

Generally, a display apparatus includes a display panel and a panel driver. The display panel includes a plurality of gate lines and a plurality of data lines. The panel driver includes a gate driver providing gate signals to the gate lines and a data driver providing data voltages to the data lines.

The display panel displays an image based on the gate signals and the data voltages. When a previous image is repeatedly displayed on the display panel and a new image different from the repeated previous image is then displayed on the display panel, a faint outline of the previous image may remain visible. This phenomenon is known as image sticking.

SUMMARY

At least one exemplary embodiment of the present inventive concept provides a timing controller capable of improving display quality.

At least one exemplary embodiment of the present inventive concept provides a display apparatus including the timing controller.

A timing controller according to an exemplary embodiment of the present inventive concept includes an image determining part configured to determine whether an input image is a static image based on input image data, a signal controller (e.g., a data enable signal controller) configured to shift a timing of a first data enable signal to generate a second data enable signal when the input image is the static image, and a signal generator configured to generate control signals based on the second data enable signal.

In an exemplary embodiment, the signal controller is configured to shift the timing of the first data enable signal by a unit of a horizontal period.

In an exemplary embodiment, the signal controller is configured to shift the timing of the first data enable signal to a first direction by the unit of a horizontal period in a first frame. The signal controller may be configured to shift the timing of the first data enable signal to a second direction opposite to the first direction by the unit of a horizontal period in a second frame subsequent to the first frame.

In an exemplary embodiment, the signal controller is configured to shift the timing of the first data enable signal by a unit of a pixel period corresponding to one pixel.

In an exemplary embodiment, the signal controller is configured to shift the timing of the first data enable signal to a first direction by the unit of a pixel period in a first frame. The signal controller may be configured to shift the timing of the first data enable signal to a second direction opposite to the first direction by the unit of a pixel period in a second frame subsequent to the first frame.

In an exemplary embodiment, the signal controller is configured to further generate a data select signal. The signal generator may include a multiplexer configured to select one of the input image data and dummy image data based on the data select signal.

In an exemplary embodiment, an image based on the dummy image data is a black image.

In an exemplary embodiment, the timing controller further includes a line memory configured to store the input image data.

In an exemplary embodiment, the signal generator is configured to further generate a memory control signal and a data select signal, the memory control signal controlling operations of the line memory. The line memory may be configured to store first input image data during a first duration based on the memory control signal. The signal generator may include a multiplexer configured to select one of the input image data and the first input image data based on the data select signal.

In an exemplary embodiment, the first duration may correspond to one of a first horizontal period and a last horizontal period of a first frame.

In an exemplary embodiment, the first duration may correspond to a period during which outermost pixels of a first frame receive image data.

In an exemplary embodiment, the signal controller is configured to generate a third data enable signal substantially the same as the first data enable signal when the input image is not the static image.

A display apparatus according to an exemplary embodiment of the present inventive concept includes a timing controller including an image determining part configured to determine whether an input image is a static image based on input image data, a signal controller configured to shift a timing of a first data enable signal to generate a second data enable signal when the input image is the static image, and a signal generator configured to generate first and second control signals based on the second data enable signal, a gate driver configured to generate gate signals based on the first control signal, a data driver configured to generate data voltages based on the second control signal, and a display panel including gate lines extending in a first direction, data lines extending in a second direction crossing the first direction and a plurality of pixels, and configured to display an image based on the gate signals and the data voltages.

In an exemplary embodiment, the signal controller is configured to shift the timing of the first data enable signal by a unit of a horizontal period. The display panel may be configured to display an image shifted to the second direction.

In an exemplary embodiment, the signal controller is configured to shift the timing of the first data enable signal by a unit of a pixel period corresponding to one pixel. The display panel may be configured to display an image shifted to the first direction.

In an exemplary embodiment, the signal controller is configured to further generate a data select signal. The signal generator may include a multiplexer configured to select one of the input image data and dummy image data based on the data select signal.

In an exemplary embodiment, the display panel is configured to display a black image based on the dummy image data.

In an exemplary embodiment, the signal generator is configured to further generate a memory control signal and a data select signal. The timing controller may further include a line memory configured to store first input image data during a first duration based on the memory control signal. The signal generator may include a multiplexer configured to select one of the input image data and the first input image data based on the data select signal.

In an exemplary embodiment, the first duration corresponds to one of a first horizontal period and a last horizontal period of a first frame.

In an exemplary embodiment, the first duration corresponds to a pixel period during which outermost pixels of a first frame receiving image data.

According to an exemplary embodiment of the inventive concept, a timing controller include: a signal controller configured to shift a timing of a data enable signal when an input image is a static image based on input image data; a data signal generator configured to output one of the input image data and dummy image data to a data driver in response to a data select signal from the signal controller; and a control signal generator configured to output a control signal based on the data enable signal to a gate driver.

The dummy image data may be one of black image data and white image data. The data select signal may be set to cause output of the dummy image data during first part of a frame period and to cause output of the part of the input image data during a second part of the frame period.

According to at least one exemplary embodiment of the inventive concept, image ghosting or image sticking can be reduced without relying on an extra memory. Thus, display quality of a display panel can be improved.

BRIEF DESCRIPTION OF THE DRAWINGS

The present inventive concept will become more apparent by describing in detail exemplary embodiments thereof with reference to the accompanying drawings, in which.

DETAILED DESCRIPTION OF EXEMPLARY EMBODIMENTS

Hereinafter, exemplary embodiments of the present inventive concept will be explained in detail with reference to the accompanying drawings. However, the present inventive concept may be embodied in various different ways and should not be construed as limited to the exemplary embodiments described herein. As used herein, the singular forms, "a," "an" and "the" are intended to include the plural forms as well, unless the context clearly indicates otherwise.

Figure 1:
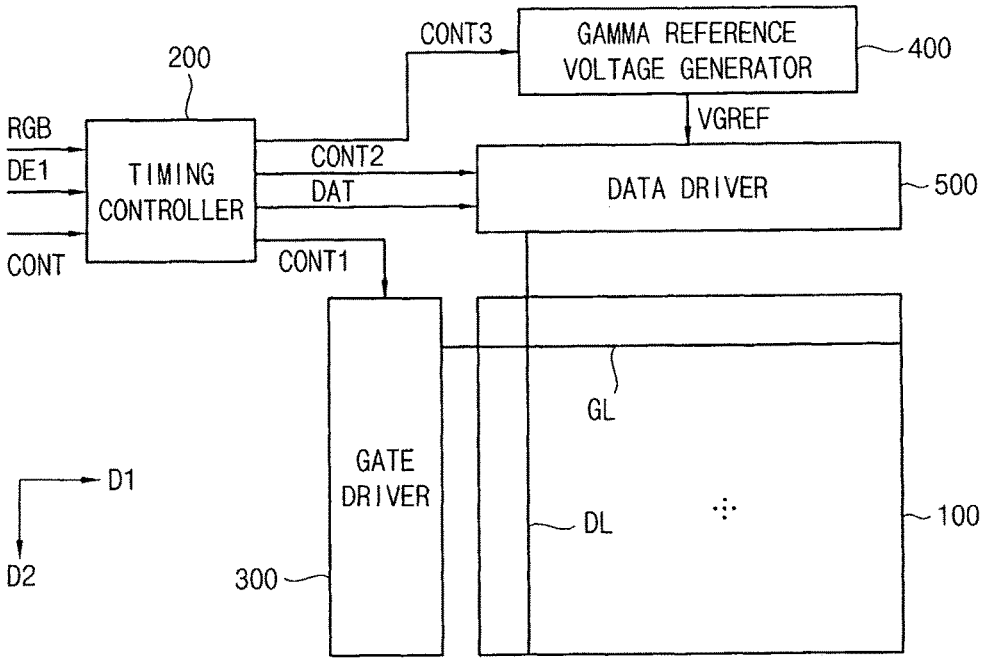
FIG. 1 is a block diagram illustrating a display apparatus according to exemplary embodiments.

FIG. 1 is a block diagram illustrating a display apparatus according to exemplary embodiment of the inventive concept.

Referring to FIG. 1, the display apparatus includes a display panel 100 and a panel driver. The panel driver includes a timing controller 200, a gate driver 300, a gamma reference voltage generator 400 and a data driver 500.

The display panel 100 includes a display region for displaying an image and a peripheral region adjacent to the display region. The peripheral region may surround the display region.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1. The first direction D1 may be a horizontal direction. The first direction D1 may extend from left to right. The second direction D2 may be a vertical direction. The second direction D2 may extend from above to below.

The display panel 100 may include first through m-th horizontal lines extending in the first direction and arranged along the second direction D2. Each of the first through m-th horizontal lines may include one row of the pixels. The display panel 100 may include first through n-th pixels arranged along the first direction D1.

In an exemplary embodiment, each pixel includes a switching element (not shown), a liquid crystal capacitor (not shown) and a storage capacitor (not shown). The liquid crystal capacitor and the storage capacitor may be electrically connected to the switching element. The pixels may be arranged in an m*n matrix configuration, where m and n are natural numbers greater than or equal to one. In other words, the arrangement of the pixels may be n columns along the first direction D1 and m rows along the second direction D2.

The timing controller 200 may receive input image data RGB, a first data enable signal DE1 and an input control signal CONT from an external device (not shown). The input image data RGB may include red image data R, green image data G and blue image data B. The input control signal CONT may include a master clock signal. The input control signal CONT may further include a vertical synchronizing signal and a horizontal synchronizing signal.

The timing controller 200 generates a first control signal CONT1, a second control signal CONT2, a third control signal CONT3 and a data signal DAT based on the input image data RGB, the first data enable signal DE1 and the input control signal CONT.

The timing controller 200 generates the first control signal CONT1 for controlling operations of the gate driver 300 based on the first data enable signal DE1 and the input control signal CONT, and outputs the first control signal CONT1 to the gate driver 300. The first control signal CONT1 may include a vertical start signal and a gate clock signal.

The timing controller 200 generates the second control signal CONT2 for controlling operations of the data driver 500 based on the first data enable signal DE1 and the input control signal CONT, and outputs the second control signal CONT2 to the data driver 500. The second control signal CONT2 may include a horizontal start signal and a load signal.

The timing controller 200 generates the data signal DAT based on the first data enable signal DE1 and the input image data RGB. The timing controller 200 outputs the data signal DAT to the data driver 500. The data signal DAT may be the same or substantially the same image data as the input image data RGB or the data signal DAT may be compensated image data generated by compensating the input image data RGB. For example, the timing controller 200 may selectively perform an image quality compensation, a spot compensation, an adaptive color correction (ACC), and/or a dynamic capacitance compensation (DCC) on the input image data RGB to generate the data signal DAT.

The timing controller 200 generates the third control signal CONT3 for controlling operations of the gamma reference voltage generator 400 based on the first data enable signal DE1 and the input control signal CONT, and outputs the third control signal CONT3 to the gamma reference voltage generator 400.

The operations of the timing controller 200 will be explained in detail with reference to FIG. 2.

The gate driver 300 generates gate signals for driving the gate lines GL in response to the first control signal CONT1 received from the timing controller 200. The gate driver 300 controls timings of the gate signals based on the first control signal CONT1. The gate driver 300 sequentially outputs the gate signals to the gate lines GL.

In exemplary embodiments, the gate driver 300 may be directly mounted on the display panel 100, or may be connected to the display panel 100 as a tape carrier package (TCP) type. Alternatively, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

In some exemplary embodiments, the gamma reference voltage generator 400 may be disposed in the timing controller 200, or may be disposed in the data driver 500.

The data driver 500 receives the second control signal CONT2 and the data signal DAT from the timing controller 200, and receives the gamma reference voltage VGREF from the gamma reference voltage generator 400. The data driver 500 converts the data signal DAT to data voltages having analog levels based on the gamma reference voltage VGREF. The data driver 500 outputs the data voltages to the data lines DL. The data driver 500 controls timing of outputting the data voltages based on the second control signal CONT2.

In some exemplary embodiments, the data driver 500 may be directly mounted on the display panel 100, or may be connected to the display panel 100 as a tape carrier package (TCP) type. Alternatively, the data driver 500 may be integrated on the peripheral region of the display panel 100.

Figure 2:
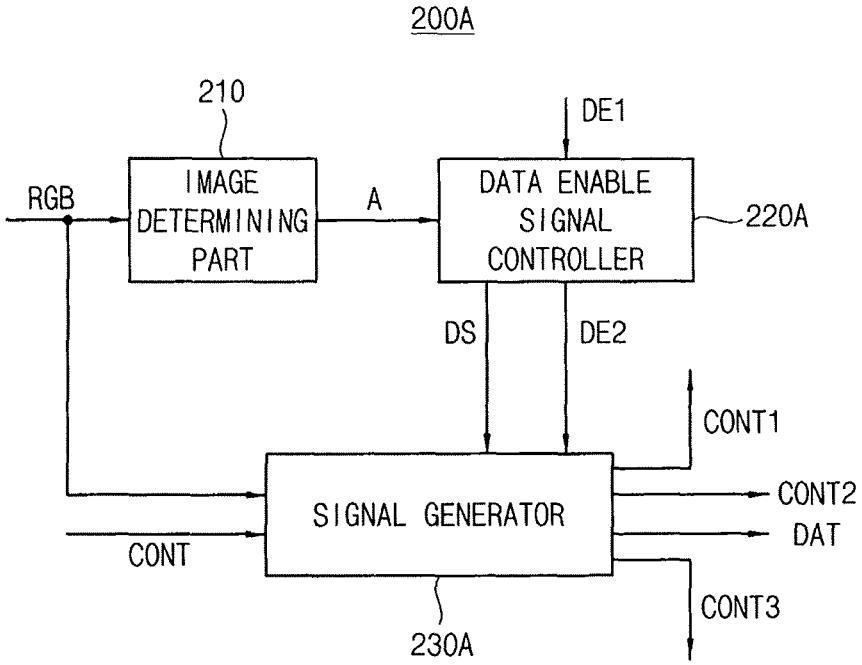
FIG. 2 is a block diagram illustrating a timing controller according to an exemplary embodiment of the inventive concept.

FIG. 2 is a block diagram illustrating a timing controller according to an exemplary embodiment of the inventive concept that may be used to implement the timing controller 200 of FIG. 1.

Referring to FIGS. 1 and 2, a timing controller 200A includes an image determining part 210 (e.g., a circuit), a data enable signal controller 220A (e.g., a controller or a control circuit) and a signal generator 230A.

The image determining part 210 determines whether an input image is a stable image (e.g., a still image, a static image, a stopped image, a photograph, etc.) or a dynamic image (e.g., a moving image, a video, etc.) based on the input image data RGB. In an embodiment, the image determining part 210 includes a buffer to store a previous image, and a comparison circuit (e.g., a comparator, an OR gate, an XOR gate, etc) that compares the previous image with a current input image to determine whether the current image is the stable or the dynamic image. For example, if the current image is the same as the previous image or only differs by a small threshold amount, it can be concluded that the current image is stable image. The image determining part 210 outputs a determination signal A to the data enable signal controller 220A. In an embodiment, the determination signal A indicates whether the input image is one of the stable image and the dynamic image. For example, the determination signal A could be set to a first logic level when the input image is the stable image and set to a second other logic level when the input image is the dynamic image.

The data enable signal controller 220A receives the first data enable signal DE1. The data enable signal controller 220A shifts a timing of the first data enable signal DE1 when the determination signal A indicates the input image is the stable image. The data enable signal controller 220A may shift the timing of the first data enable signal DE1 by a unit of a horizontal period. The data enable signal controller 220A may shift the timing of the first data enable signal DE1 by a unit of a pixel period corresponding to one pixel. The data enable signal controller 220A shifts the timing of the first data enable signal DE1 to generate a second data enable signal DE2. The data enable signal controller 220A outputs the second data enable signal DE2 to the signal generator 230A. In an embodiment, image data for an entire horizontal line of the display panel 100 is applied to the pixels of the display panel corresponding to the line during the horizontal period. In an embodiment, image data for a single pixel within the horizontal line is applied to the single pixel during the pixel period.

The first data enable signal DE1 and the second data enable signal DE2 will be explained in detail with reference to FIGS. 4A, 4B and 5.

In an embodiment, the data enable signal controller 220A generates a data select signal DS based on the determination signal A when the input image is the stable image. The data enable signal controller 220A may output the data select signal DS to the signal generator 230A.

The data select signal DS will be explained in detail with reference to FIG. 3.

The signal generator 230A generates the first control signal CONT1, the second control signal CONT2 and the third control signal CONT3 based on the second data enable signal DE2 and the input control signal CONT. The signal generator 230A outputs the first control signal CONT1 to the gate driver 300. The signal generator 230A outputs the second control signal CONT2 to the data driver 500. The signal generator 230A outputs the third control signal CONT3 to the gamma reference voltage generator 400.

The signal generator 230A may generate the data signal DAT based on the second data enable signal DE2 and the input image data RGB. The signal generator 230A outputs the data signal DAT to the data driver 500.

The signal generator 230A may generate the data signal DAT based on the input image data RGB and the data select signal DS. The signal generator 230A outputs the data signal DAT to the data driver 500.

The operations of the signal generator 230A will be explained in detail with reference to FIG. 3.

Figure 3:
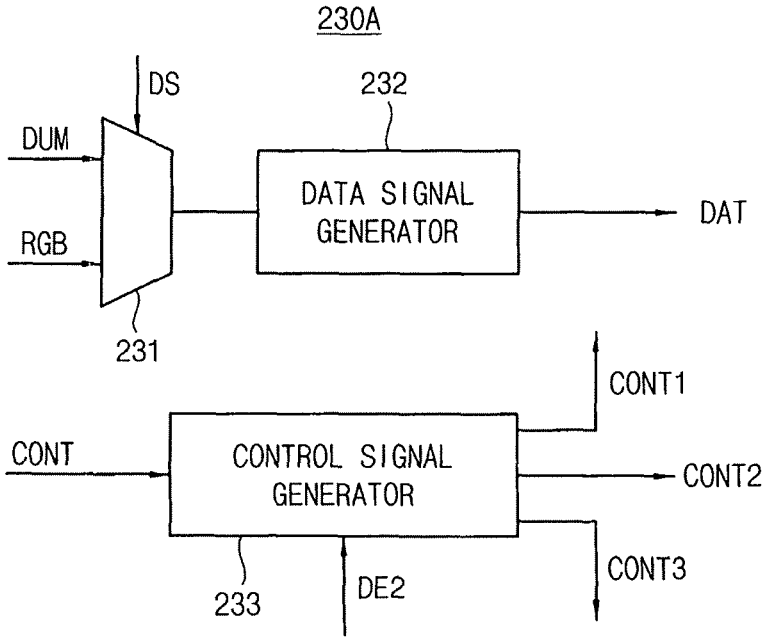
FIG. 3 is a block diagram illustrating a signal generator included in a timing controller according to an exemplary embodiment of the inventive concept.

FIG. 3 is a block diagram illustrating a signal generator included in a timing controller according to an exemplary embodiment of the inventive concept. The signal generator 230*a* of FIG. 2 may be implemented by the signal generator 230*a* of FIG. 3.

Referring to FIGS. 1 through 3, the signal generator 230A includes a data signal generator 232 and a control signal generator 233. The signal generator 230A may further include a multiplexer 231.

The multiplexer 231 selects one of a dummy image data DUM and the input image data RGB based on the data select signal DS. The multiplexer 231 may output the selected one to the data signal generator 232.

The data signal generator 232 may generate the data signal DAT based on the dummy image data DUM or the input image data RGB. The data signal generator 232 outputs the data signal DAT to the data driver 500. In an embodiment, an image based on the data signal DAT generated based on the dummy image data DUM is a black image. In an alternate embodiment, an image based on the data signal DAT generated based on the dummy image data DUM is a white image. In an embodiment, a black image is image data set to a lowest grayscale value supported by the display panel 100, and a white image is image data set to a highest grayscale value supported by the display panel 100.

The control signal generator 233 generates the first control signal CONT1, the second control signal CONT2 and the third control signal CONT3 based on the second data enable signal DE2 and the input control signal CONT. The control signal generator 233 outputs the first control signal CONT1 to the gate driver 300. The first control signal CONT1 controls a timing of the gate driver 300. The control signal generator 233 outputs the second control signal CONT2 to the data driver 500. The second control signal CONT2 controls a timing of the data driver 500. The control signal generator 233 outputs the third control signal CONT3 to the gamma reference voltage generator 400. The third control signal CONT3 controls a timing of the gamma reference voltage generator 400.

Figure 4A:
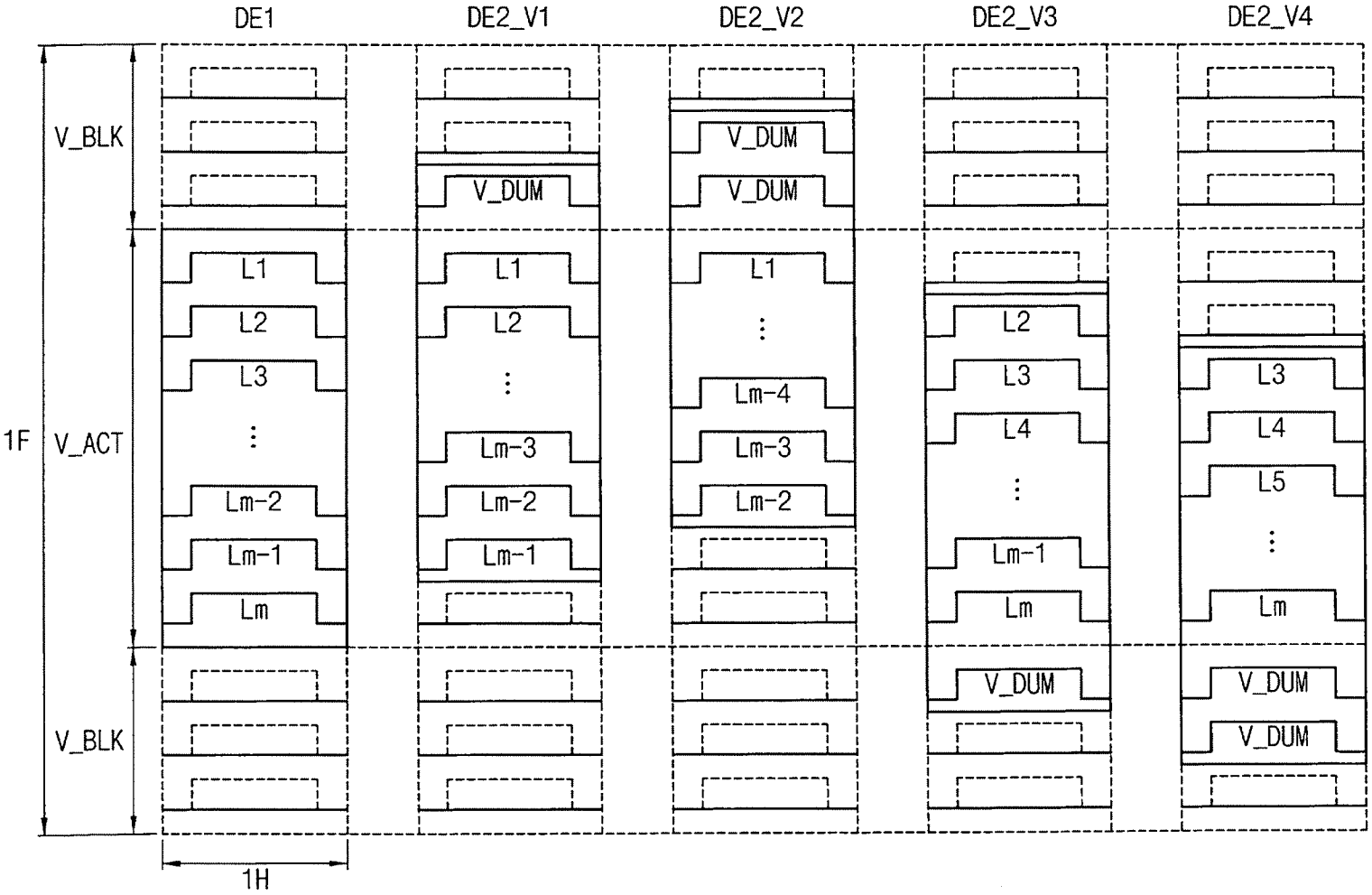
FIGS. 4A and 4B are diagrams illustrating examples of data enable signals shifted by a unit of a horizontal period according to exemplary embodiments of the inventive concept.
Figure 4B:
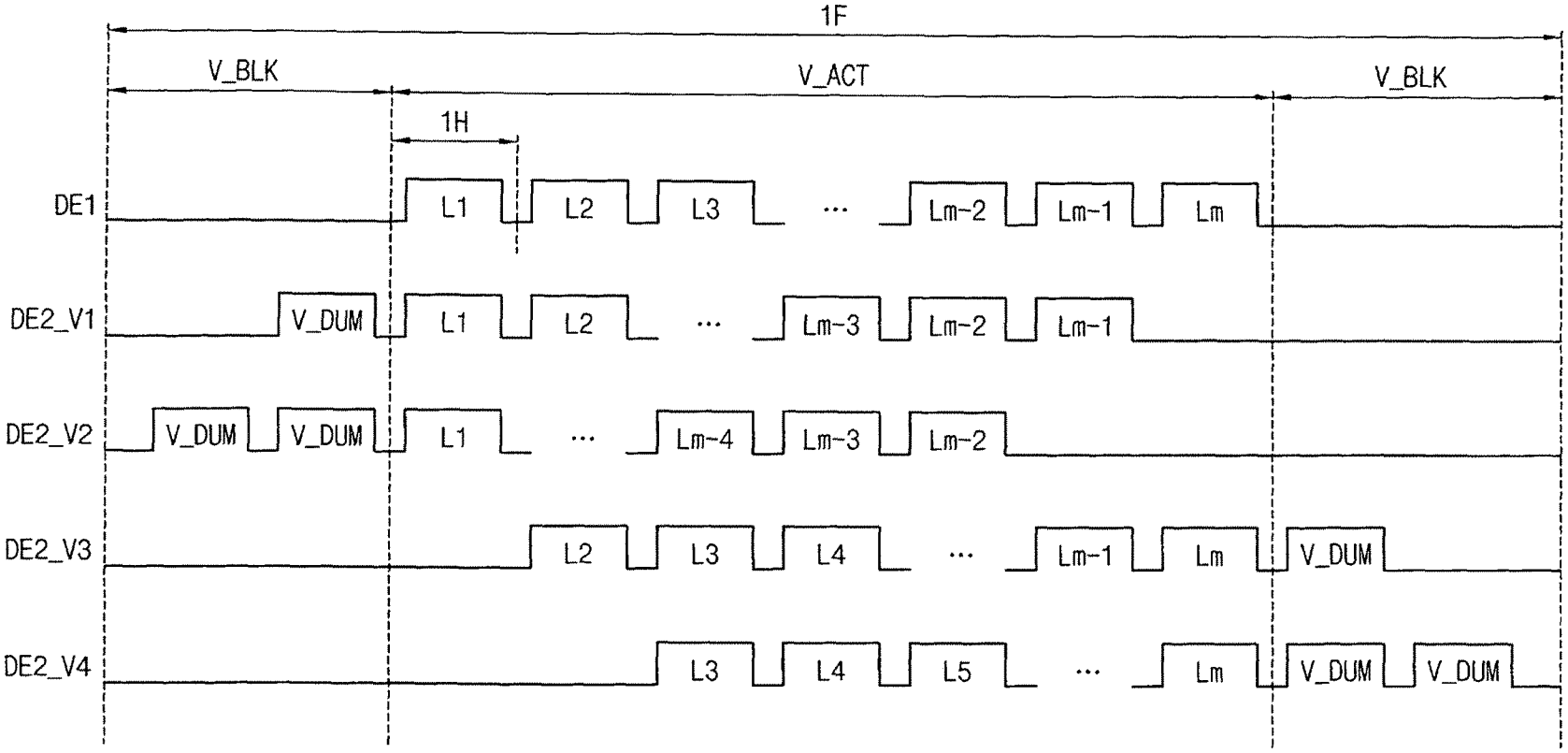

FIGS. 4A and 4B are diagrams illustrating examples of data enable signals shifted by a unit of a horizontal period according to exemplary embodiments of the inventive concept.

Referring to FIGS. 1 through 3, 4A and 4B, a frame 1F includes a vertical blank duration V_BLK and a vertical active duration V_ACT. The vertical active duration V_ACT may include first through m-th horizontal active durations L1~Lm. The frame IF may refer to a single frame period during which an entire frame of image data (e.g., data for an entire display panel) is output to the display panel 100. The vertical blank duration V_BLK may occur at the beginning and at the end of the frame period, where the vertical active duration V_ACT occurs between the vertical blank durations.

The first data enable signal DE1 has a low level during the vertical blank duration V_BLK. The first data enable signal DE1 has a high level in every horizontal active duration during the vertical active duration V_ACT. For example, the first data enable signal DE1 has the high level during each of the first through m-th horizontal active durations L1~Lm.

An image based on the first data enable signal DE1 is an original image based on the input image data RGB. For example, in the image based on the first data enable signal DE1, data corresponding to the first horizontal active duration L1 is displayed on the first horizontal line of the display panel 100. In the image based on the first data enable signal DE1, data corresponding to the second horizontal active duration L2 is displayed on the second horizontal line of the display panel 100. In the image based on the first data enable signal DE1, data corresponding to the (m−1)-th horizontal active duration Lm−1 is displayed on the (m−1)-th horizontal line of the display panel 100. In the image based on the first data enable signal DE1, data corresponding to the m-th horizontal active duration Lm is displayed on the m-th horizontal line of the display panel 100.

In an embodiment, the data enable signal controller 220A brings the timing of the first data enable signal DE1 earlier by one horizontal period based when the determination signal A indicates the original image is the stable image to generate a first example of the second data enable signal DE2_V1. For example, the first data enable signal DE1 may be shifted to the left by one horizontal period. For example, the data enable signal controller 220*a* may include a shift register that is used to perform the shifting.

The first example of the second data enable signal DE2_V1 has the high level during one dummy horizontal active duration V_DUM before the first horizontal active duration L1. The first example of the second data enable signal DE2_V1 has the high level during each of the first through (m−1)-th horizontal active durations L1~Lm−1. The first example of the second data enable signal DE2_V1 has the low level during the m-th horizontal active duration Lm.

In an embodiment, the multiplexer 231 selects the dummy image data DUM during the one dummy horizontal active duration V_DUM before the first horizontal active duration L1 based on the data select signal DS. In an embodiment, the multiplexer 231 selects the input image data RGB during the first through (m−1)-th horizontal active durations L1~Lm−1 based on the data select signal DS.

An image based on the first example of the second data enable signal DE2_V1 is an image shifted below by one horizontal line compared to the original image. The m-th horizontal line may be below the first horizontal line. For example, in the image based on the first example of the second data enable signal DE2_V1, the dummy image data DUM is displayed on the first horizontal line of the display panel 100. In the image based on the first example of the second data enable signal DE2_V1, data corresponding to the first horizontal active duration L1 is displayed on the second horizontal line of the display panel 100. In the image based on the first example of the second data enable signal DE2_V1, data corresponding to the second horizontal active duration L2 is displayed on the third horizontal line of the display panel 100. In the image based on the first example of the second data enable signal DE2_V1, data corresponding to the (m−2)-th horizontal active duration Lm−2 is displayed on the (m−1)-th horizontal line of the display panel 100. In the image based on the first example of the second data enable signal DE2_V1, data corresponding to the (m−1)-th horizontal active duration Lm−1 is displayed on the m-th horizontal line of the display panel 100. In the image based on the first example of the second data enable signal DE2_V1, data corresponding to the m-th horizontal active duration Lm is not displayed on the display panel 100.

In an embodiment, the data enable signal controller 220A brings the timing of the first data enable signal DE1 earlier by two horizontal periods when the determination signal A indicates the original image is the stable image to generate a second example of the second data enable signal DE2_V2. For example, the first data enable signal DE1 may be shifted to the left by two horizontal periods.

The second example of the second data enable signal DE2_V2 has the high level during each of two dummy horizontal active durations V_DUM before the first horizontal active duration L1. The second example of the second data enable signal DE2_V2 has the high level during each of the first through (m−2)-th horizontal active durations L1~Lm−2. The second example of the second data enable signal DE2_V2 has the low level during each of the (m−1)-th and m-th horizontal active durations Lm−1, Lm.

In an embodiment, the multiplexer 231 selects the dummy image data DUM during the two dummy horizontal active durations V_DUM before the first horizontal active duration L1 based on the data select signal DS. In an embodiment, the multiplexer 231 selects the input image data RGB during the first through (m−2)-th horizontal active durations L1~Lm−2 based on the data select signal DS.

An image based on the second example of the second data enable signal DE2_V2 is an image shifted below by two horizontal lines compared to the original image. The m-th horizontal line may be below the first horizontal line. For example, in the image based on the second example of the second data enable signal DE2_V2, the dummy image data DUM is displayed on the first and second horizontal lines of the display panel 100. In the image based on the second example of the second data enable signal DE2_V2, data corresponding to the first horizontal active duration L1 is displayed on the third horizontal line of the display panel 100. In the image based on the second example of the second data enable signal DE2_V2, data corresponding to the (m−3)-th horizontal active duration Lm−3 is displayed on the (m−1)-th horizontal line of the display panel 100. In the image based on the second example of the second data enable signal DE2_V2, data corresponding to the (m−2)-th horizontal active duration Lm−2 is displayed on the m-th horizontal line of the display panel 100. In the image based on the second example of the second data enable signal DE2_V2, data corresponding to the (m−1)-th and m-th horizontal active durations Lm−1, Lm is not displayed on the display panel 100.

In an exemplary embodiment, the data enable signal controller 220A delays the timing of the first data enable signal DE1 by one horizontal period when the determination signal A indicates the original image is the stable image to generate a third example of the second data enable signal DE2_V3. The data enable signal controller 220*a* may include a buffer to delay the first data enable signal DE1 or a shift register to shift the first enable signal DE1 to the right by one horizontal period.

The third example of the second data enable signal DE2_V3 has the low level during the first horizontal active duration L1. The third example of the second data enable signal DE2_V3 has the high level during each of the second through m-th horizontal active durations L2~Lm. The third example of the second data enable signal DE2_V3 has the high level during one dummy horizontal active duration V_DUM after the m-th horizontal active duration Lm.

In an embodiment, the multiplexer 231 selects the dummy image data DUM during the one dummy horizontal active duration V_DUM after the m-th horizontal active duration Lm based on the data select signal DS. In an embodiment, the multiplexer 231 selects the input image data RGB during the second through m-th horizontal active durations L2~Lm based on the data select signal DS.

An image based on the third example of the second data enable signal DE2_V3 is an image shifted above by one horizontal line compared to the original image. The first horizontal line may be above the m-th horizontal line. For example, in the image based on the third example of the second data enable signal DE2_V3, data corresponding to the first horizontal active duration L1 is not displayed on the display panel 100. In the image based on the third example of the second data enable signal DE2_V3, data corresponding to the second horizontal active duration L2 is displayed on the first horizontal line of the display panel 100. In the image based on the third example of the second data enable signal DE2_V3, data corresponding to the third horizontal active duration L3 is displayed on the second horizontal line of the display panel 100. In the image based on the third example of the second data enable signal DE2_V3, data corresponding to the (m−1)-th horizontal active duration Lm−1 is displayed on the (m−2)-th horizontal line of the display panel 100. In the image based on the third example of the second data enable signal DE2_V3, data corresponding to the m-th horizontal active duration Lm is displayed on the (m−1)-th horizontal line of the display panel 100. In the image based on the third example of the second data enable signal DE2_V3, the dummy image data DUM is displayed on the m-th horizontal line of the display panel 100.

In an embodiment, the data enable signal controller 220A delays the timing of the first data enable signal DE1 by two horizontal periods when the determination signal A indicates the original image is the stable image to generate a fourth example of the second data enable signal DE2_V4. The data enable signal controller 220*a* may include one or more buffers to delay the first data enable signal DE1 or a shift register to shift the first enable signal DE1 to the right by two horizontal periods.

The fourth example of the second data enable signal DE2_V4 has the low level during each of the first and second horizontal active duration L1, L2. The fourth example of the second data enable signal DE2_V4 has the high level during each of the third through m-th horizontal active durations L3~Lm. The fourth example of the second data enable signal DE2_V4 has the high level during each of two dummy horizontal active durations V_DUM after the m-th horizontal active duration Lm.

In an embodiment, the multiplexer 231 selects the dummy image data DUM during the two dummy horizontal active durations V_DUM after the m-th horizontal active duration Lm based on the data select signal DS. In an embodiment, the multiplexer 231 selects the input image data RGB during the third through m-th horizontal active durations L3~Lm based on the data select signal DS.

An image based on the fourth example of the second data enable signal DE2_V4 is an image shifted above by two horizontal lines compared to the original image. The first horizontal line may be above the m-th horizontal line. For example, in the image based on the fourth example of the second data enable signal DE2_V4, data corresponding to the first and second horizontal active durations L1, L2 is not displayed on the display panel 100. In the image based on the fourth example of the second data enable signal DE2_V4, data corresponding to the third horizontal active duration L3 is displayed on the first horizontal line of the display panel 100. In the image based on the fourth example of the second data enable signal DE2_V4, data corresponding to the fourth horizontal active duration L4 is displayed on the second horizontal line of the display panel 100. In the image based on the fourth example of the second data enable signal DE2_V4, data corresponding to the m-th horizontal active duration Lm is displayed on the (m−2)-th horizontal line of the display panel 100. In the image based on the fourth example of the second data enable signal DE2_V4, the dummy image data DUM is displayed on the (m−1)-th and m-th horizontal lines of the display panel 100.

Figure 5:
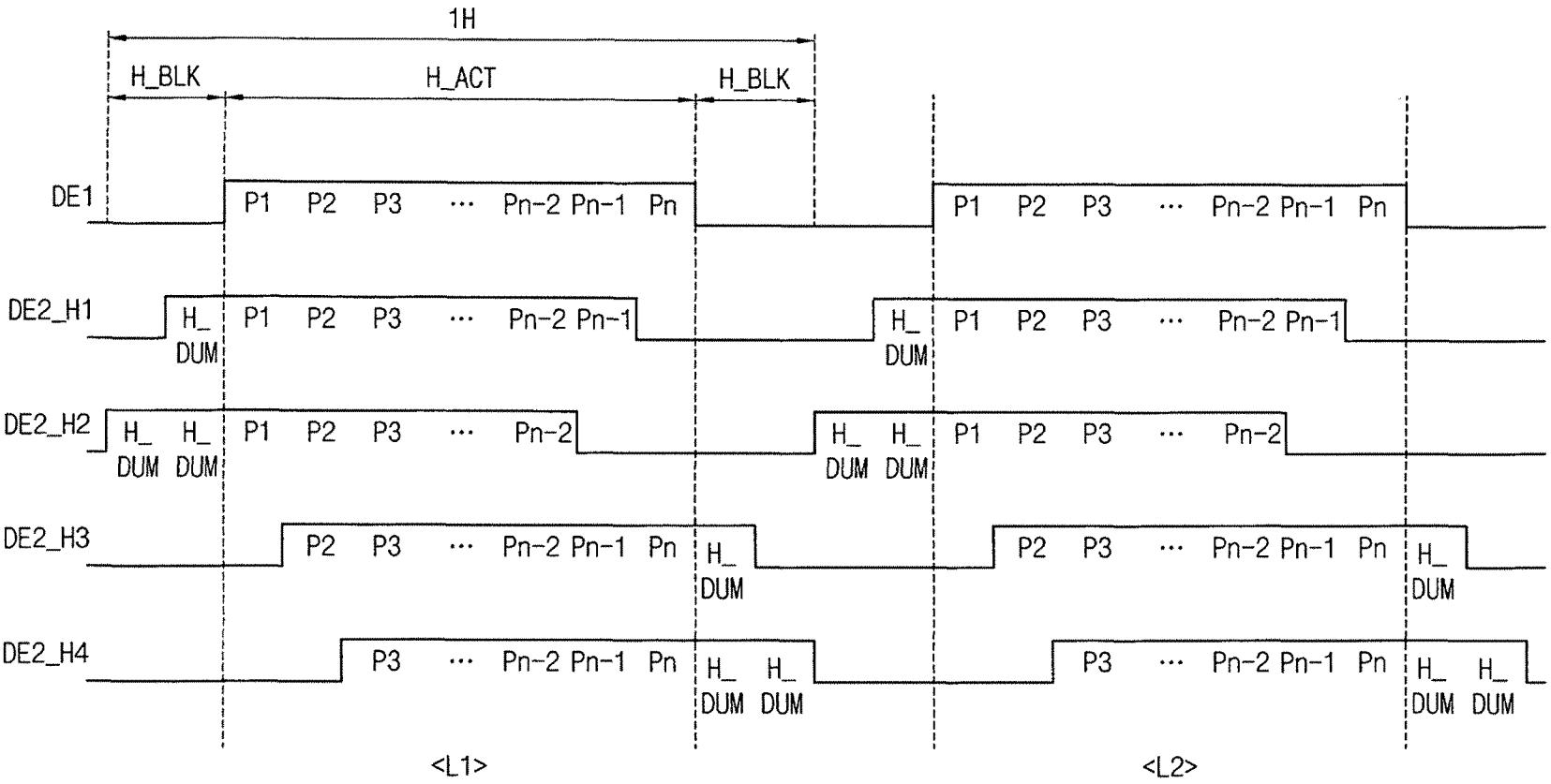
FIG. 5 is a diagram illustrating examples of data enable signals shifted by a unit of a pixel period according to exemplary embodiments of the inventive concept.

FIG. 5 is a diagram illustrating examples of data enable signals shifted by a unit of a pixel period according to exemplary embodiments of the inventive concept.

Referring to FIGS. 1 through 3 and 5, a horizontal period 1H includes a horizontal blank duration H_BLK and a horizontal active duration H_ACT. The horizontal active duration H_ACT may include first through n-th pixel durations P1~Pn. Each of the first through n-th pixel durations P1~Pn may be a duration corresponding to each of the pixel periods. The blank duration H_BLK may occur before and after the horizontal active duration H_ACT.

The first data enable signal DE1 has a high level during the horizontal active duration H_ACT. The first data enable signal DE1 has a low level in the horizontal blank duration H_BLK.

An image based on the first data enable signal DE1 is an original image based on the input image data RGB. For example, in the image based on the first data enable signal DE1, data corresponding to the first pixel duration P1 is displayed on the first pixel of the display panel 100. In the image based on the first data enable signal DE1, data corresponding to the second pixel duration P2 is displayed on the second pixel of the display panel 100. In the image based on the first data enable signal DE1, data corresponding to the (n−1)-th pixel duration Pn−1 is displayed on the (n−1)-th pixel of the display panel 100. In the image based on the first data enable signal DE1, data corresponding to the n-th pixel duration Pn is displayed on the n-th pixel of the display panel 100.

In an embodiment, the data enable signal controller 220A brings the timing of the first data enable signal DE1 earlier by one pixel period when the determination signal A indicates the original image is the stable image to generate a first example of the second data enable signal DE2_H1. For example, the data enable signal controller 220A may shift the first data enable signal DE1 to the left by one pixel period.

The first example of the second data enable signal DE2_H1 has the high level during one dummy pixel duration H_DUM before the first pixel duration P1. The first example of the second data enable signal DE2_H1 has the high level during each of the first through (n−1)-th pixel durations P1~Pn−1. The first example of the second data enable signal DE2_H1 has the low level during the n-th pixel duration Pn.

In an exemplary embodiment, the multiplexer 231 selects the dummy image data DUM during the one dummy pixel duration H_DUM before the first pixel duration P1 based on the data select signal DS. In an embodiment, the multiplexer 231 selects the input image data RGB during the first through (n−1)-th pixel durations P1~Pn−1 based on the data select signal DS.

An image based on the first example of the second data enable signal DE2_H1 is an image shifted to a right side by one pixel compared to the original image. The n-th pixel may be on the right side of the first pixel. For example, in the image based on the first example of the second data enable signal DE2_H1, the dummy image data DUM is displayed on the first pixel of the display panel 100. In the image based on the first example of the second data enable signal DE2_H1, data corresponding to the first pixel duration P1 is displayed on the second pixel of the display panel 100. In the image based on the first example of the second data enable signal DE2_H1, data corresponding to the second pixel duration P2 is displayed on the third pixel of the display panel 100. In the image based on the first example of the second data enable signal DE2_H1, data corresponding to the (n−2)-th pixel duration Pn−2 is displayed on the (n−1)-th pixel of the display panel 100. In the image based on the first example of the second data enable signal DE2_H1, data corresponding to the (n−1)-th pixel duration Pn−1 is displayed on the n-th pixel of the display panel 100. In the image based on the first example of the second data enable signal DE2_H1, data corresponding to the n-th pixel duration Pn is not displayed on the display panel 100.

In an embodiment, the data enable signal controller 220A brings the timing of the first data enable signal DE1 earlier by two pixel periods when the determination signal A indicates the original image is the stable image to generate a second example of the second data enable signal DE2_H2. For example, the data enable signal controller 220A may shift the first data enable signal to the left by two pixel periods.

The second example of the second data enable signal DE2_H2 has the high level during each of two dummy pixel durations H_DUM before the first pixel duration P1. The second example of the second data enable signal DE2_H2 has the high level during each of the first through (n−2)-th pixel durations P1~Pn−2. The second example of the second data enable signal DE2_H2 has the low level during the (n−1)-th and n-th pixel durations Pn−1, Pn.

In an embodiment, the multiplexer 231 selects the dummy image data DUM during the two dummy pixel durations H_DUM before the first pixel duration P1 based on the data select signal DS. In an embodiment, the multiplexer 231 selects the input image data RGB during the first through (n−2)-th pixel durations P1~Pn−2 based on the data select signal DS.

An image based on the second example of the second data enable signal DE2_H2 is an image shifted to the right side by two pixels compared to the original image. The n-th pixel may be on the right side of the first pixel. For example, in the image based on the second example of the second data enable signal DE2_H2, the dummy image data DUM is displayed on the first and second pixels of the display panel 100. In the image based on the second example of the second data enable signal DE2_H2, data corresponding to the first pixel duration P1 is displayed on the third pixel of the display panel 100. In the image based on the second example of the second data enable signal DE2_H2, data corresponding to the (n−3)-th pixel duration Pn−3 is displayed on the (n−1)-th pixel of the display panel 100. In the image based on the second example of the second data enable signal DE2_H2, data corresponding to the (n−2)-th pixel duration Pn−2 is displayed on the n-th pixel of the display panel 100. In the image based on the second example of the second data enable signal DE2_H2, data corresponding to the (n−1)-th and n-th pixel duration Pn−1, Pn is not displayed on the display panel 100.

In an embodiment, the data enable signal controller 220A delays the timing of the first data enable signal DE1 by one pixel period when the determination signal A indicates the original image is the stable image to generate a third example of the second data enable signal DE2_H3. For example, the data enable signal controller 220A may include a buffer to delay the first data enable signal DE1 by one pixel period or a shift register to shift the first data enable signal DE1 to the right by one pixel period.

The third example of the second data enable signal DE2_H3 has the low level during the first pixel duration P1. The third example of the second data enable signal DE2_H3 has the high level during each of the second through n-th pixel durations P2~Pn. The third example of the second data enable signal DE2_H3 has the high level during one dummy pixel duration H_DUM after the n-th pixel duration Pn.

In an embodiment, the multiplexer 231 selects the dummy image data DUM during the one dummy pixel duration H_DUM after the n-th pixel duration Pn based on the data select signal DS. In an embodiment, the multiplexer 231 selects the input image data RGB during the second through n-th pixel durations P2~Pn based on the data select signal DS.

An image based on the third example of the second data enable signal DE2_H3 is an image shifted to a left side by one pixel compared to the original image. The first pixel may be on the left side of the n-th pixel. For example, in the image based on the third example of the second data enable signal DE2_H3, data corresponding to the first pixel duration P1 is not displayed on the display panel 100. In the image based on the third example of the second data enable signal DE2_H3, data corresponding to the second pixel duration P2 is displayed on the first pixel of the display panel 100. In the image based on the third example of the second data enable signal DE2_H3, data corresponding to the third pixel duration P3 is displayed on the second pixel of the display panel 100. In the image based on the third example of the second data enable signal DE2_H3, data corresponding to the (n−1)-th pixel duration Pn−1 is displayed on the (n−2)-th pixel of the display panel 100. In the image based on the third example of the second data enable signal DE2_H3, data corresponding to the n-th pixel duration Pn−1 is displayed on the (n−1)-th pixel of the display panel 100. In the image based on the third example of the second data enable signal DE2_H3, the dummy image data DUM is displayed on the n-th pixel of the display panel 100.

In an embodiment, the data enable signal controller 220A delays the timing of the first data enable signal DE1 by two pixel periods when the determination signal A indicates the original image is the stable image to generate a fourth example of the second data enable signal DE2_H4. For example, the data enable signal controller 220A may include buffers to delay the first data enable signal DE1 by two pixel periods or a shift register to shift the first data enable signal DE1 to the right by two pixel periods.

The fourth example of the second data enable signal DE2_H4 has the low level during the first and second pixel durations P1, P2. The fourth example of the second data enable signal DE2_H4 has the high level during each of the third through n-th pixel durations P3~Pn. The fourth example of the second data enable signal DE2_H4 has the high level during two dummy pixel durations H_DUM after the n-th pixel duration Pn.

In an embodiment, the multiplexer 231 selects the dummy image data DUM during the two dummy pixel durations H_DUM after the n-th pixel duration Pn based on the data select signal DS. In an embodiment, the multiplexer 231 selects the input image data RGB during the third through n-th pixel durations P3~Pn based on the data select signal DS.

An image based on the fourth example of the second data enable signal DE2_H4 is an image shifted to the left side by two pixels compared to the original image. The first pixel may be on the left side of the n-th pixel. For example, in the image based on the fourth example of the second data enable signal DE2_H4, data corresponding to the first and second pixel durations P1, P2 is not displayed on the display panel 100. In the image based on the fourth example of the second data enable signal DE2_H4, data corresponding to the third pixel duration P3 is displayed on the first pixel of the display panel 100. In the image based on the fourth example of the second data enable signal DE2_H4, data corresponding to the fourth pixel duration P4 is displayed on the second pixel of the display panel 100. In the image based on the fourth example of the second data enable signal DE2_H4, data corresponding to the n-th pixel duration Pn is displayed on the (n−2)-th pixel of the display panel 100. In the image based on the fourth example of the second data enable signal DE2_H4, the dummy image data DUM is displayed on the (n−1)-th and n-th pixels of the display panel 100. In an embodiment, the first through n-th pixels refer to a single row of the display panel 100.

Figure 6A:
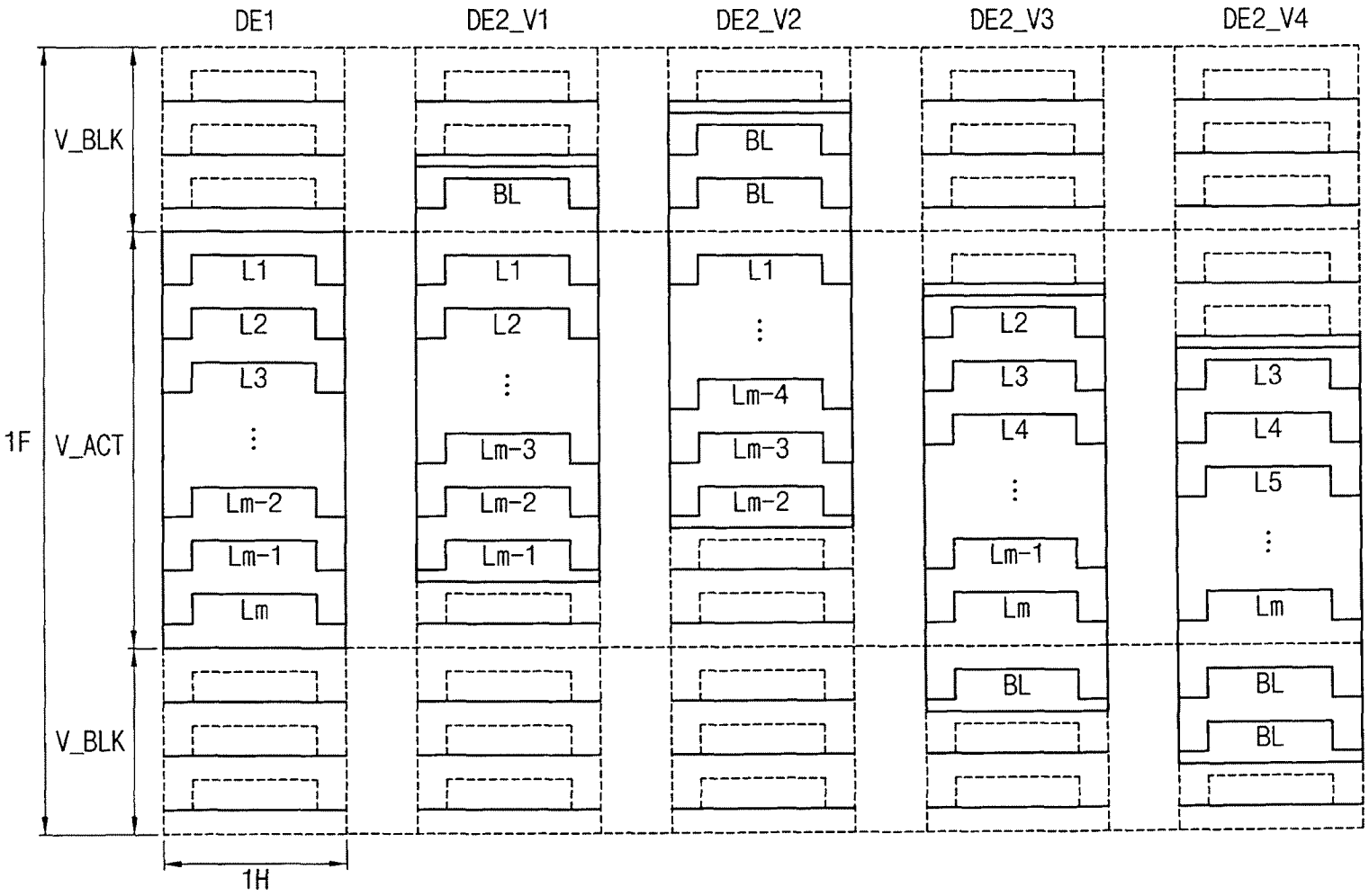
FIG. 6A is a diagram illustrating outputting dummy image data during a vertical dummy duration in FIG. 4A according to an exemplary embodiment of the inventive concept.

FIG. 6A is a diagram illustrating outputting dummy image data during a vertical dummy duration in FIG. 4A according to exemplary embodiments of the inventive concept.

Referring to FIGS. 1 through 3, 4A and 6A, the first example of the second data enable signal DE2_V1 has the high level during one dummy horizontal active duration V_DUM before the first horizontal active duration L1.

In an embodiment, the multiplexer 231 selects the dummy image data DUM during the one dummy horizontal active duration V_DUM before the first horizontal active duration L1 based on the data select signal DS. For example, an image based on the dummy image data DUM may be a black image BL. Alternatively, the image based on the dummy image data DUM may be a white image.

The image based on the first example of the second data enable signal DE2_V1 is the image shifted below by one horizontal line compared to the original image. The m-th horizontal line may be below the first horizontal line. For example, in the image based on the first example of the second data enable signal DE2_V1, the black image BL may be displayed on the first horizontal line of the display panel 100. Alternatively, in the image based on the first example of the second data enable signal DE2_V1, the white image may be displayed on the first horizontal line of the display panel 100.

The second example of the second data enable signal DE2_V2 has the high level during two dummy horizontal active durations V_DUM before the first horizontal active duration L1.

In an embodiment, the multiplexer 231 selects the dummy image data DUM during the two dummy horizontal active durations V_DUM before the first horizontal active duration L1 based on the data select signal DS. For example, an image based on the dummy image data DUM may be the black image BL. Alternatively, the image based on the dummy image data DUM may be the white image.

The image based on the second example of the second data enable signal DE2_V2 is the image shifted below by two horizontal lines compared to the original image. The m-th horizontal line may be below the first horizontal line. For example, in the image based on the second example of the second data enable signal DE2_V2, the black image BL may be displayed on the first and second horizontal lines of the display panel 100. Alternatively, in the image based on the second example of the second data enable signal DE2_V2, the white image may be displayed on the first and second horizontal lines of the display panel 100.

The third example of the second data enable signal DE2_V3 has the high level during one dummy horizontal active duration V_DUM after the m-th horizontal active duration Lm.

In an embodiment, the multiplexer 231 selects the dummy image data DUM during the one dummy horizontal active duration V_DUM after the m-th horizontal active duration Lm based on the data select signal DS. For example, an image based on the dummy image data DUM may be the black image BL. Alternatively, the image based on the dummy image data DUM may be the white image.

The image based on the third example of the second data enable signal DE2_V3 is the image shifted above by one horizontal line compared to the original image. The first horizontal line may be above the m-th horizontal line. For example, in the image based on the third example of the second data enable signal DE2_V3, the black image BL may be displayed on the m-th horizontal line of the display panel 100. Alternatively, in the image based on the third example of the second data enable signal DE2_V3, the white image may be displayed on the m-th horizontal line of the display panel 100.

The fourth example of the second data enable signal DE2_V4 has the high level during two dummy horizontal active durations V_DUM after the m-th horizontal active duration Lm.

In an embodiment, the multiplexer 231 selects the dummy image data DUM during the two dummy horizontal active durations V_DUM after the m-th horizontal active duration Lm based on the data select signal DS. For example, an image based on the dummy image data DUM may be the black image BL. Alternatively, the image based on the dummy image data DUM may be the white image.

The image based on the fourth example of the second data enable signal DE2_V4 is the image shifted above by two horizontal lines compared to the original image. The first horizontal line may be above the m-th horizontal line. For example, in the image based on the fourth example of the second data enable signal DE2_V4, the black image BL may be displayed on the (m−1)-th and m-th horizontal lines of the display panel 100. Alternatively, in the image based on the fourth example of the second data enable signal DE2_V4, the white image may be displayed on the (m−1)-th and m-th horizontal lines of the display panel 100.

Figure 6B:
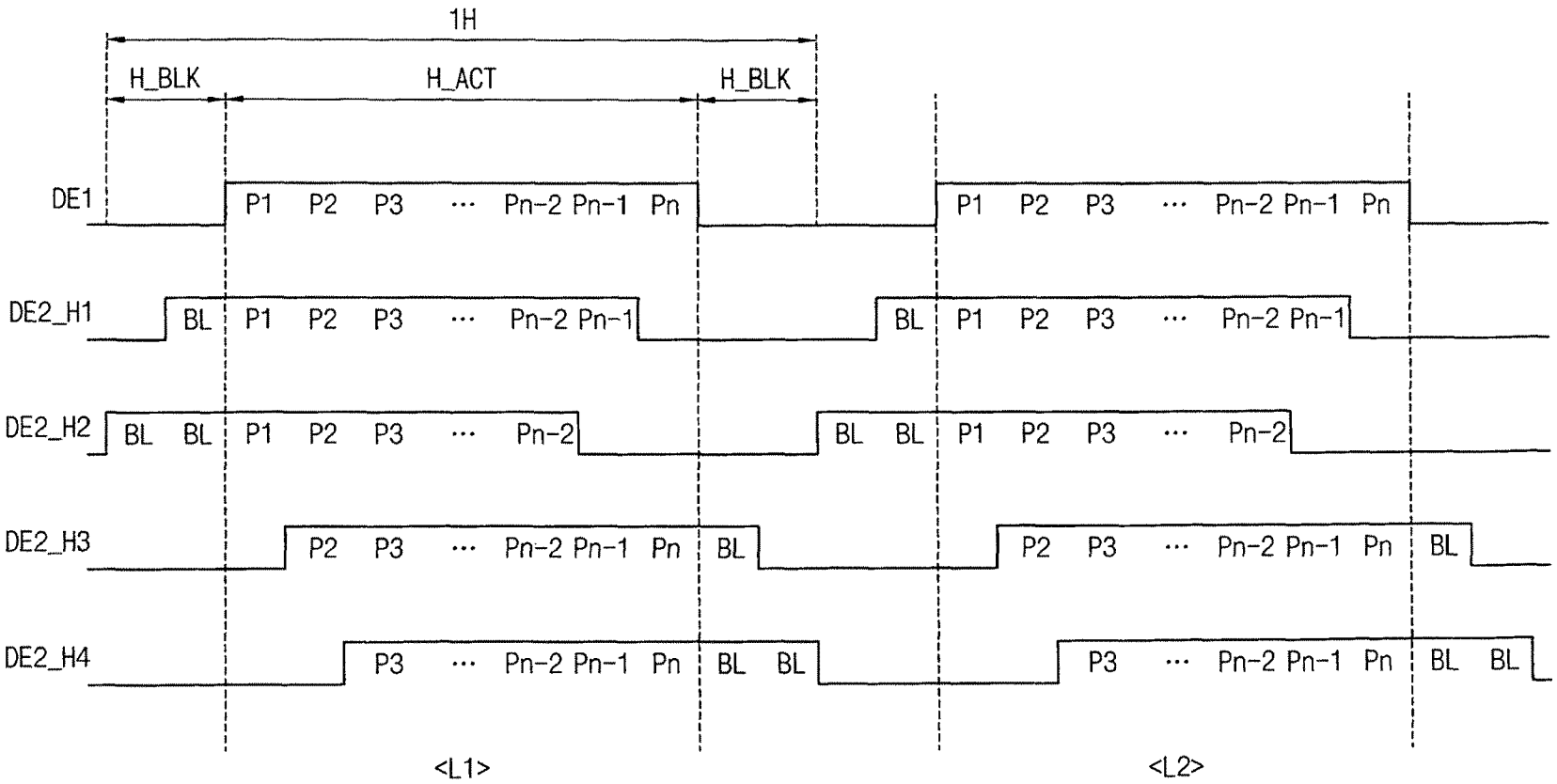
FIG. 6B is a diagram illustrating outputting dummy image data during a horizontal dummy duration in FIG. 5 according to an exemplary embodiment of the inventive concept.

FIG. 6B is a diagram illustrating outputting dummy image data during a horizontal dummy duration in FIG. 5 according to exemplary embodiments of the inventive concept.

Referring to FIGS. 1 through 3, 5 and 6B, the first example of the second data enable signal DE2_H1 has the high level during one dummy pixel duration H_DUM before the first pixel duration P1.

In an embodiment, the multiplexer 231 selects the dummy image data DUM during the one dummy pixel duration H_DUM before the first pixel duration P1 based on the data select signal DS. For example, an image based on the dummy image data DUM may be a black image BL. Alternatively, the image based on the dummy image data DUM may be a white image.

The image based on the first example of the second data enable signal DE2_H1 is the image shifted to the right side by one pixel compared to the original image. The n-th pixel may be on the right side of the first pixel. For example, in the image based on the first example of the second data enable signal DE2_H1, the black image BL may be displayed on the first pixel of the display panel 100. Alternatively, in the image based on the first example of the second data enable signal DE2_H1, the white image may be displayed on the first pixel of the display panel 100.

The second example of the second data enable signal DE2_H2 has the high level during two dummy pixel durations H_DUM before the first pixel duration P1.

In an embodiment, the multiplexer 231 selects the dummy image data DUM during the two dummy pixel duration H_DUM before the first pixel duration P1 based on the data select signal DS. For example, an image based on the dummy image data DUM may be the black image BL. Alternatively, the image based on the dummy image data DUM may be the white image.

The image based on the second example of the second data enable signal DE2_H2 is the image shifted to the right side by two pixels compared to the original image. The n-th pixel may be on the right side of the first pixel. For example, in the image based on the second example of the second data enable signal DE2_H2, the black image BL may be displayed on the first and second pixels of the display panel 100. Alternatively, in the image based on the second example of the second data enable signal DE2_H2, the white image may be displayed on the first and second pixels of the display panel 100.

The third example of the second data enable signal DE2_H3 has the high level during one dummy pixel duration H_DUM after the n-th pixel duration Pn.

In an embodiment, the multiplexer 231 selects the dummy image data DUM during the one dummy pixel duration H_DUM after the n-th pixel duration Pn based on the data select signal DS. For example, an image based on the dummy image data DUM may be the black image BL. Alternatively, the image based on the dummy image data DUM may be the white image.

The image based on the third example of the second data enable signal DE2_H3 is the image shifted to the left side by one pixel compared to the original image. The first pixel may be on the left side of the n-th pixel. For example, in the image based on the third example of the second data enable signal DE2_H3, the black image BL may be displayed on the n-th pixel of the display panel 100. Alternatively, in the image based on the third example of the second data enable signal DE2_H3, the white image may be displayed on the n-th pixel of the display panel 100.

The fourth example of the second data enable signal DE2_H4 has the high level during two dummy pixel durations H_DUM after the n-th pixel duration Pn.

In an embodiment, the multiplexer 231 selects the dummy image data DUM during the two dummy pixel durations H_DUM after the n-th pixel duration Pn based on the data select signal DS. For example, an image based on the dummy image data DUM may be the black image BL. Alternatively, the image based on the dummy image data DUM may be the white image.

The image based on the fourth example of the second data enable signal DE2_H4 is the image shifted to the left side by two pixels compared to the original image. The first pixel may be on the left side of the n-th pixel. For example, in the image based on the fourth example of the second data enable signal DE2_H4, the black image BL may be displayed on the (n−1)-th and n-th pixels of the display panel 100. Alternatively, in the image based on the fourth example of the second data enable signal DE2_H4, the white image may be displayed on the (n−1)-th and n-th pixels of the display panel 100.

Figure 7A:
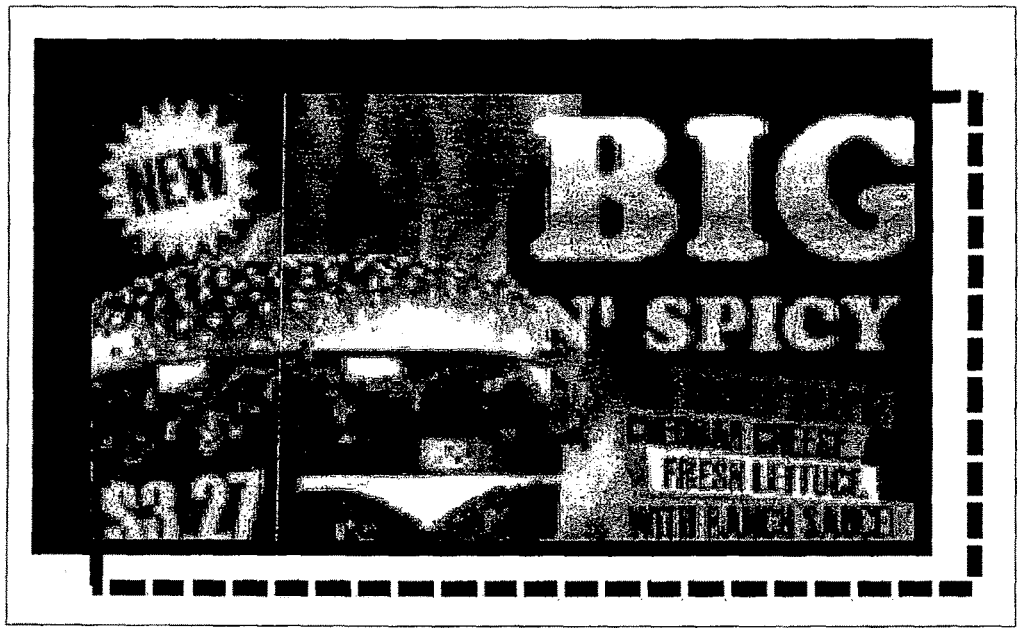
FIGS. 7A and 7B are diagrams illustrating examples of an image displayed on a display panel included in a display apparatus according to exemplary embodiments.
Figure 7A:
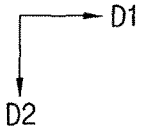
Figure 7B:
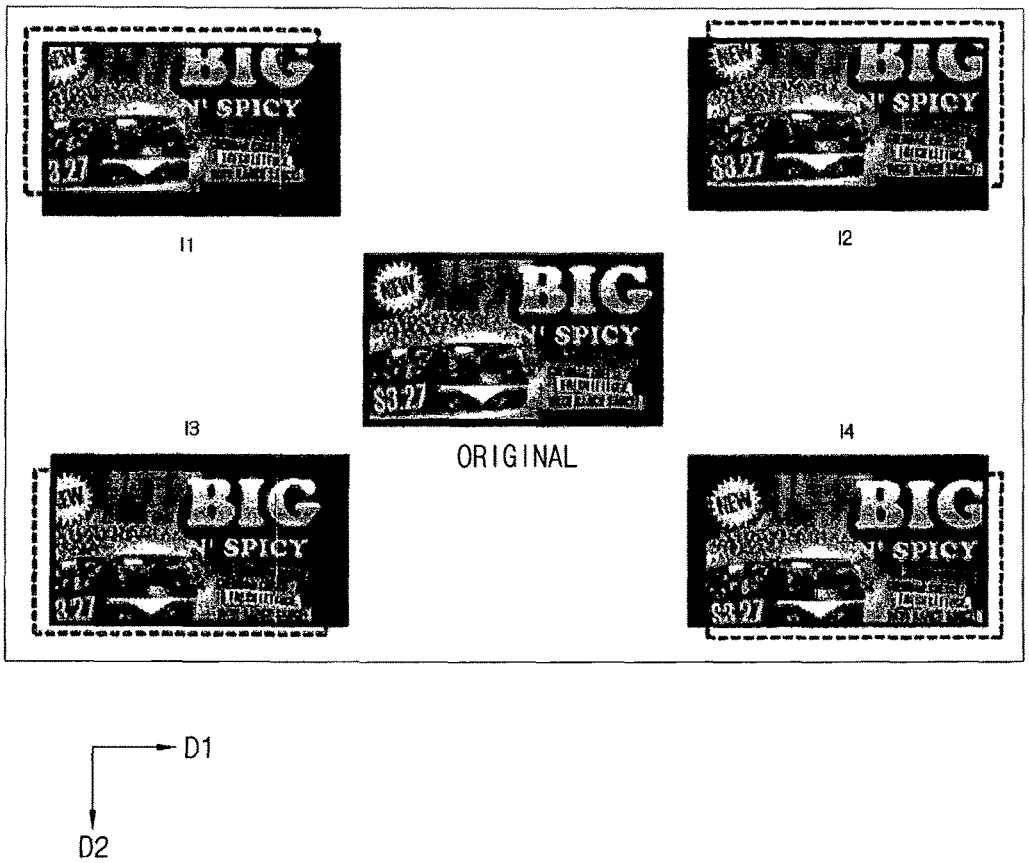

FIGS. 7A and 7B are diagrams illustrating examples of an image displayed on a display panel included in a display apparatus according to exemplary embodiments of the inventive concept.

Figure 8:
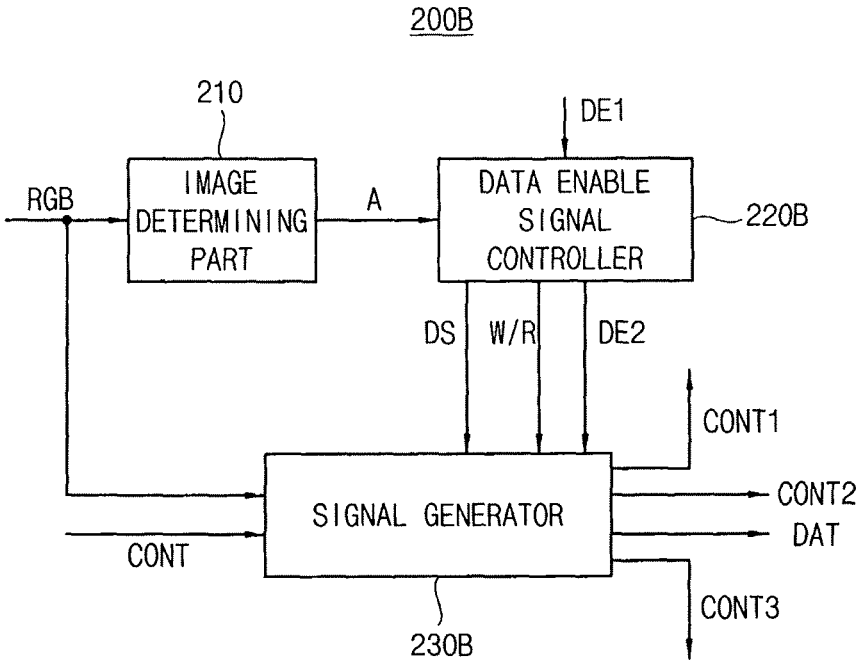
FIG. 8 is a block diagram illustrating a timing controller according to an exemplary embodiment of the inventive concept.
Figure 9:
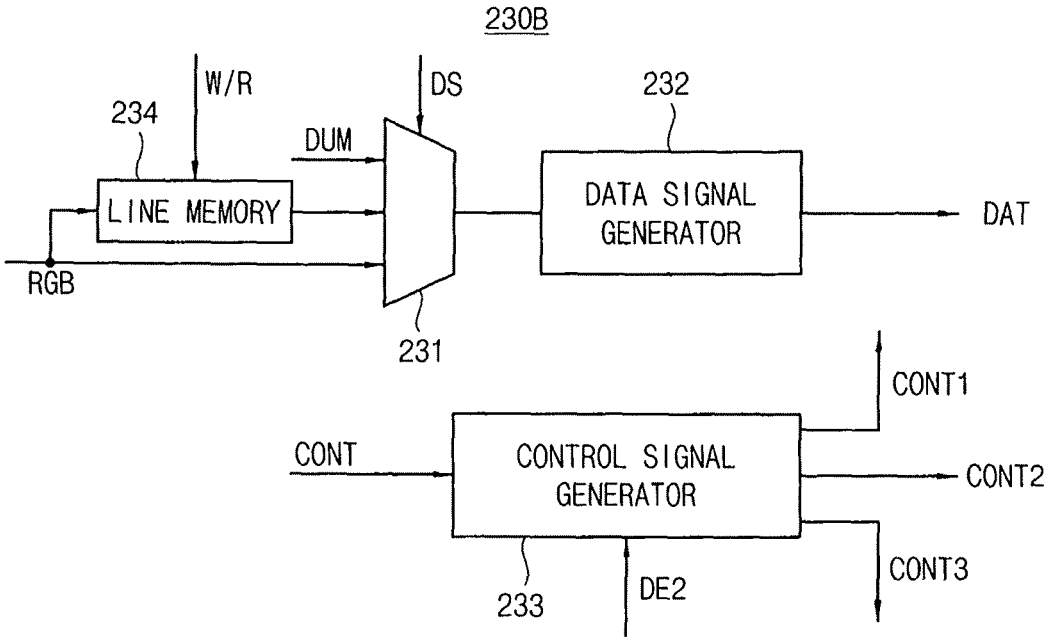
FIG. 9 is a block diagram illustrating a signal generator included in a timing controller according to an exemplary embodiment of the inventive concept.

FIG. 8 is a block diagram illustrating a timing controller according to an exemplary embodiment of the inventive concept. The timing controller 200B of FIG. 8 may be used to implement the timing controller of FIG. 1. FIG. 9 is a block diagram illustrating a signal generator included in a timing controller according to an exemplary embodiment of the inventive concept. The signal generator 230B of FIG. 9 may be included within the timing controller of FIG. 8, or the timing controller of FIG. 1. Hereinafter, any repetitive explanation concerning FIGS. 1, 2 and 3 will be omitted.

Referring to FIGS. 1 through 3, 8 and 9, a timing controller 200B includes the image determining part 210 (e.g., a circuit), a data enable signal controller 220B (e.g., a controller or a control circuit) and a signal generator 230B.

The signal generator 230B includes the data signal generator 232, the control signal generator 233, the multiplexer 231 and a line memory 234.

The data enable signal controller 220B may further generate a memory control signal W/R and a data select signal DS. The memory control signal W/R may control operations of the line memory 234.

The line memory 234 may store one horizontal period or one pixel period portion of the input image data. For example, the line memory 234 may store a first horizontal period or a last horizontal period of a first frame based on the memory control signal W/R. The memory control signal W/R may be a write control signal or a read control signal. The line memory 234 may store image data for a most outer pixel of each horizontal period based on the memory control signal W/R.

In an embodiment, the multiplexer 231 selects one of the input image data RGB and the stored one horizontal period or the stored one pixel period portion of the input image data based on the data select signal DS.

Figure 10A:
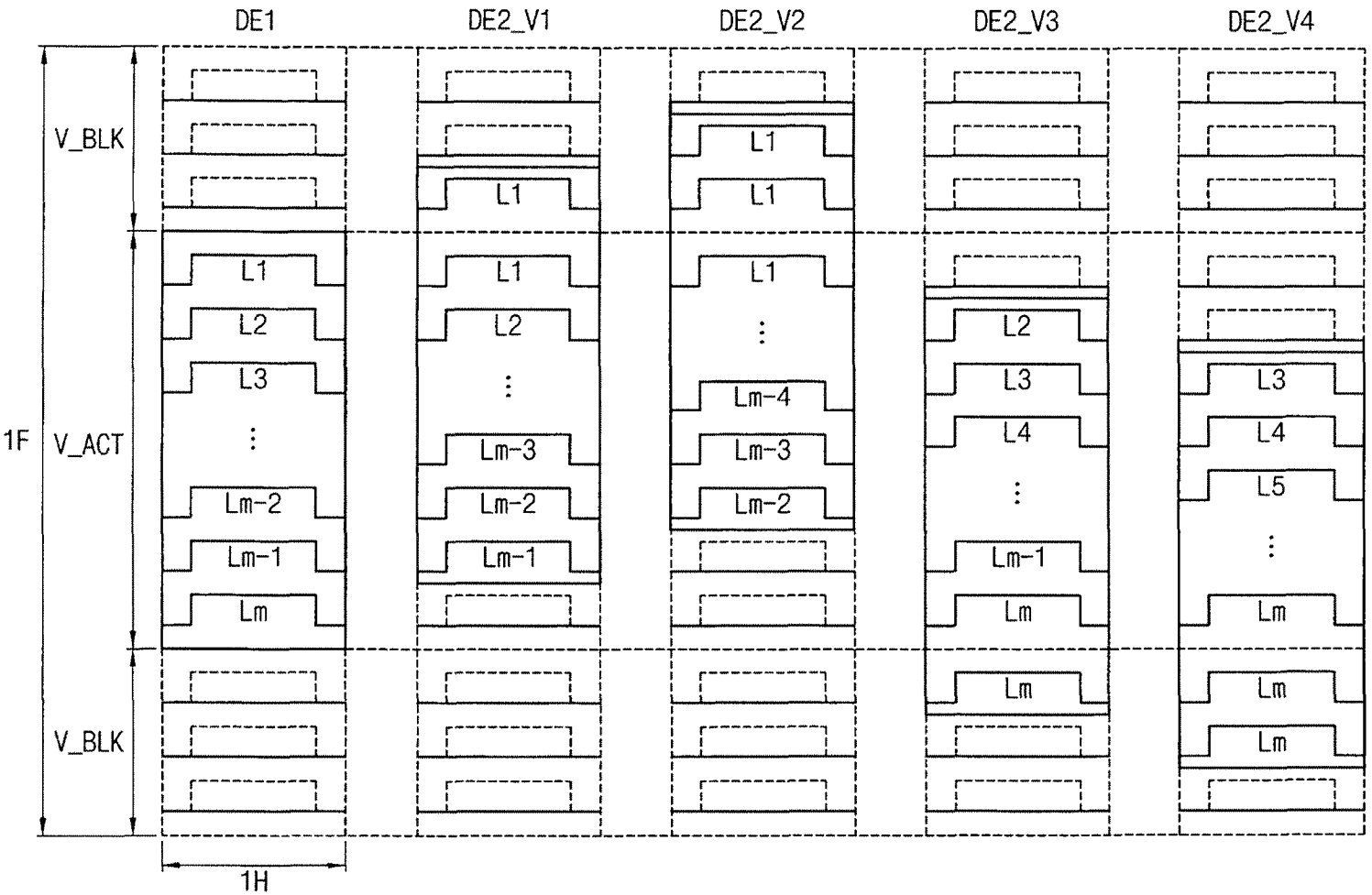
FIG. 10A is a diagram illustrating outputting stored input image data during a vertical dummy duration in FIG. 4A according to an exemplary embodiment of the inventive concept.

FIG. 10A is a diagram illustrating outputting stored input image data during a vertical dummy duration in FIG. 4A according to exemplary embodiments of the inventive concept.

Referring to FIGS. 1, 4A, 8, 9 and 10A, the first example of the second data enable signal DE2_V1 has the high level during one dummy horizontal active duration V_DUM before the first horizontal active duration L1.

The line memory 234 stores input image data corresponding to the first horizontal line of a previous frame.

In an embodiment, the multiplexer 231 selects the stored input image data corresponding to the first horizontal line of the previous frame during the one dummy horizontal active duration V_DUM before the first horizontal active duration L1 based on the data select signal DS.

The image based on the first example of the second data enable signal DE2_V1 is the image shifted below by one horizontal line compared to the original image. The m-th horizontal line may be below the first horizontal line. For example, in the image based on the first example of the second data enable signal DE2_V1, an image corresponding to the first horizontal line of the previous frame may be displayed on the first horizontal line of the display panel 100.

The second example of the second data enable signal DE2_V2 has the high level during two dummy horizontal active durations V_DUM before the first horizontal active duration L1.

The line memory 234 stores input image data corresponding to the first horizontal line of the previous frame.

In an embodiment, the multiplexer 231 selects the stored input image data corresponding to the first horizontal line of the previous frame during the two dummy horizontal active durations V_DUM before the first horizontal active duration L1 based on the data select signal DS.

The image based on the second example of the second data enable signal DE2_V2 is the image shifted below by two horizontal line compared to the original image. The m-th horizontal line may be below the first horizontal line. For example, in the image based on the second example of the second data enable signal DE2_V2, an image corresponding to the first horizontal line of the previous frame may be displayed on the first and second horizontal lines of the display panel 100.

The third example of the second data enable signal DE2_V3 has the high level during one dummy horizontal active duration V_DUM after the m-th horizontal active duration Lm.

The line memory 234 stores input image data corresponding to the m-th horizontal line of a present frame.

In an embodiment, the multiplexer 231 selects the stored input image data corresponding to the m-th horizontal line of the present frame during the one dummy horizontal active duration V_DUM after the m-th horizontal active duration Lm based on the data select signal DS.

The image based on the third example of the second data enable signal DE2_V3 is the image shifted above by one horizontal line compared to the original image. The first horizontal line may be above the m-th horizontal line. For example, in the image based on the third example of the second data enable signal DE2_V3, an image corresponding to the m-th horizontal line of the present frame may be displayed on the m-th horizontal line of the display panel 100.

The fourth example of the second data enable signal DE2_V4 has the high level during two dummy horizontal active durations V_DUM after the m-th horizontal active duration Lm.

The line memory 234 stores input image data corresponding to the m-th horizontal line of the present frame.

In an embodiment, multiplexer 231 selects the stored input image data corresponding to the m-th horizontal line of the present frame during the two dummy horizontal active durations V_DUM after the m-th horizontal active duration Lm based on the data select signal DS.

The image based on the fourth example of the second data enable signal DE2_V4 is the image shifted above by two horizontal lines compared to the original image. The first horizontal line may be above the m-th horizontal line. For example, in the image based on the fourth example of the second data enable signal DE2_V4, an image corresponding to the m-th horizontal line of the present frame may be displayed on the (m−1)-th and m-th horizontal lines of the display panel 100.

Figure 10B:
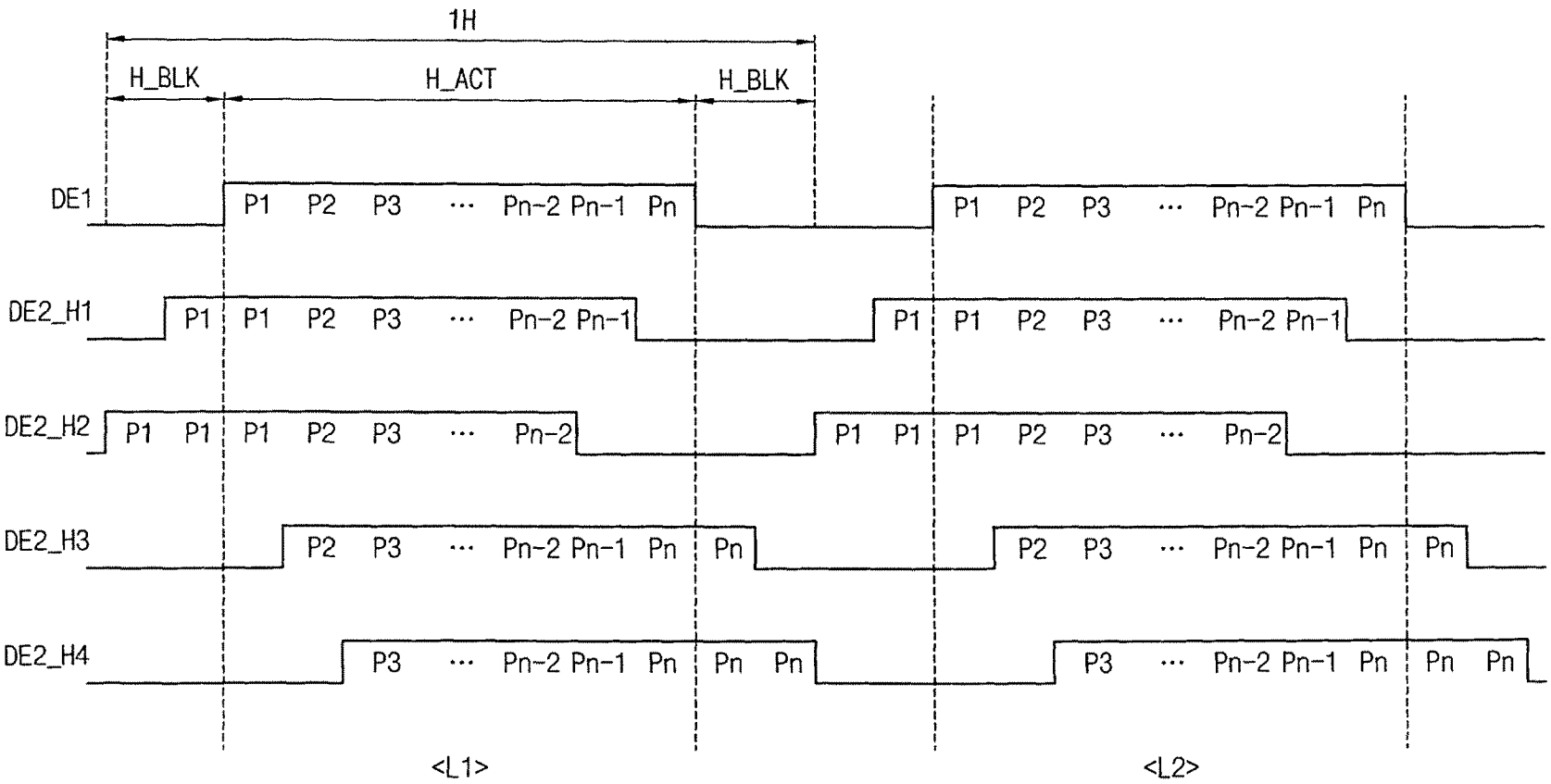
FIG. 10B is a diagram illustrating outputting stored input image data during a horizontal dummy duration in FIG. 5 according to an exemplary embodiment of the inventive concept.

FIG. 10B is a diagram illustrating outputting stored input image data during a horizontal dummy duration in FIG. 5 according to exemplary embodiments of the inventive concept.

Referring to FIGS. 1, 5, 8, 9 and 10B, the first example of the second data enable signal DE2_H1 has the high level during one dummy pixel duration H_DUM before the first pixel duration P1.

The line memory 234 stores input image data corresponding to the first pixel of a previous horizontal period.

In an embodiment, the multiplexer 231 selects the stored input image data corresponding to the first pixel of the previous horizontal period during the one dummy pixel duration H_DUM before the first pixel duration P1 based on the data select signal DS.

The image based on the first example of the second data enable signal DE2_H1 is the image shifted to the right side by one pixel compared to the original image. The n-th pixel may be on the right side the first pixel. For example, in the image based on the first example of the second data enable signal DE2_H1, an image corresponding to the first pixel of the previous horizontal period may be displayed on the first pixel of the display panel 100.

The second example of the second data enable signal DE2_H2 has the high level during two dummy pixel durations H_DUM before the first pixel duration P1.

The line memory 234 stores input image data corresponding to the first pixel of the previous horizontal period.

In an embodiment, the multiplexer 231 selects the stored input image data corresponding to the first pixel of the previous horizontal period during the two dummy pixel durations H_DUM before the first pixel duration P1 based on the data select signal DS.

The image based on the second example of the second data enable signal DE2_H2 is the image shifted to the right side by two pixels compared to the original image. The n-th pixel may be on the right side the first pixel. For example, in the image based on the second example of the second data enable signal DE2_H2, an image corresponding to the first pixel of the previous horizontal period may be displayed on the first and second pixels of the display panel 100.

The third example of the second data enable signal DE2_H3 has the high level during one dummy pixel duration H_DUM after the n-th pixel duration Pn.

The line memory 234 stores input image data corresponding to the n-th pixel of a present horizontal period.

In an embodiment, the multiplexer 231 selects the stored input image data corresponding to the n-th pixel of the present horizontal period during the one dummy pixel duration H_DUM after the n-th pixel duration Pn based on the data select signal DS.

The image based on the third example of the second data enable signal DE2_H3 is the image shifted to the left side by one pixel compared to the original image. The first pixel may be on the left side the n-th pixel. For example, in the image based on the third example of the second data enable signal DE2_H3, an image corresponding to the n-th pixel of the present horizontal period may be displayed on the n-th pixel of the display panel 100.

The fourth example of the second data enable signal DE2_H4 has the high level during two dummy pixel durations H_DUM after the n-th pixel duration Pn.

The line memory 234 stores input image data corresponding to the n-th pixel of the present horizontal period.

In an embodiment, the multiplexer 231 selects the stored input image data corresponding to the n-th pixel of the present horizontal period during the two dummy pixel durations H_DUM after the n-th pixel duration Pn based on the data select signal DS.

The image based on the fourth example of the second data enable signal DE2_H4 is the image shifted to the left side by two pixels compared to the original image. The first pixel may be on the left side the n-th pixel. For example, in the image based on the fourth example of the second data enable signal DE2_H4, an image corresponding to the n-th pixel of the present horizontal period may be displayed on the (n−1)-th and n-th pixels of the display panel 100.

Figure 11:
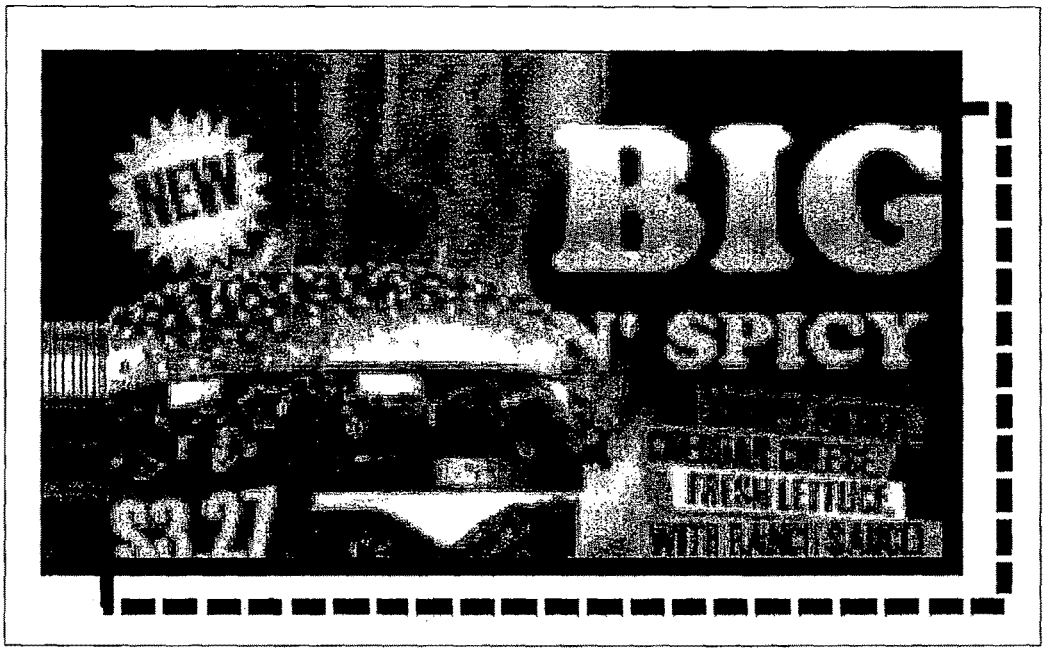
FIG. 11 is a diagram illustrating examples of an image displayed on a display panel included in a display apparatus according to exemplary embodiments of the inventive concept.
Figure 11:
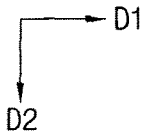

FIG. 11 is a diagram illustrating examples of an image displayed on a display panel included in a display apparatus according to exemplary embodiments of the inventive concept.

The above described embodiments may be used in a display apparatus and/or a system including the display apparatus, such as a mobile phone, a smart phone, a PDA, a PMP, a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of exemplary embodiments of the inventive concept and is not to be construed as limiting thereof. Although a few exemplary embodiments have been described, those skilled in the art will readily appreciate that many modifications are possible in the exemplary embodiments without materially departing from the present inventive concept. Accordingly, all such modifications are intended to be included within the scope of the present inventive concept.

What is claimed is:

1. A timing controller comprising:

an image determining part configured to determine whether an input image is a static image based on input image data;

a signal controller configured to shift a timing of a first data enable signal to generate a second data enable signal when the input image is the static image; and a signal generator configured to generate control signals based on the second data enable signal, wherein the first data enable signal includes a plurality of pulses during an active period, and the signal controller generates the second data enable signal by shifting the first data enable signal so that at least one of the pulses occurs during a blank period.

2. The timing controller of claim 1, wherein the signal controller is configured to shift the timing of the first data enable signal by a unit of a horizontal period.

3. The timing controller of claim 2, wherein the signal controller is configured to shift the timing of the first data enable signal to a first direction by the unit of a horizontal period in a first frame, and wherein the signal controller is configured to shift the timing of the first data enable signal to a second direction opposite to the first direction by the unit of a horizontal period in a second frame adjacent and subsequent to the first frame.

4. The timing controller of claim 1, wherein the signal controller is configured to shift the timing of the first data enable signal by a unit of a pixel period corresponding to one pixel.

5. The timing controller of claim 4, wherein the signal controller is configured to shift the timing of the first data enable signal to a first direction by the unit of a pixel period in a first frame, and wherein the signal controller is configured to shift the timing of the first data enable signal to a second direction opposite to the first direction by the unit of a pixel period in a second frame adjacent and subsequent to the first frame.

6. The timing controller of claim 1, wherein the signal controller is configured to further generate a data select signal, and wherein the signal generator comprises a multiplexer configured to select one of the input image data and dummy image data based on the data select signal.

7. The timing controller of claim 6, wherein an image based on the dummy image data is a black image.

8. The timing controller of claim 1, further comprising:

a line memory configured to store the input image data.

9. The timing controller of claim 8, wherein the signal generator is configured to further generate a memory control signal and a data select signal, the memory control signal controlling operations of the line memory, wherein the line memory is configured to store first input image data during a first duration based on the memory control signal, and wherein the signal generator comprises a multiplexer configured to select one of the input image data and the first input image data based on the data select signal.

10. The timing controller of claim 9, wherein the first duration corresponds to one of a first horizontal period and a last horizontal period of a first frame.

11. The timing controller of claim 9, wherein the first duration corresponds to a period during which outermost pixels of a first frame receive image data.

12. The timing controller of claim 1, wherein the signal controller is configured to generate a third data enable signal substantially the same as the first data enable signal when the input image is not the static image.

13. A display apparatus comprising:

a timing controller comprising:

an image determining part configured to determine whether an input image is a static image based on input image data;

a signal controller configured to shift a timing of a first data enable signal to generate a second data enable signal when the input image is the static image; and a signal generator configured to generate first and second control signals based on the second data enable signal;

a gate driver configured to generate gate signals based on the first control signal;

a data driver configured to generate data voltages based on the second control signal; and a display panel including gate lines extending in a first direction, data lines extending in a second direction crossing the first direction and a plurality of pixels, and configured to display an image based on the gate signals and the data voltages, wherein the signal controller is configured to shift the timing of the first data enable signal to a first direction by a unit of a certain period in a first frame, and wherein the signal controller is configured to shift the timing of the first data enable signal to a second direction opposite to the first direction by the unit of the certain period in a second frame adjacent and subsequent to the first frame.

14. The display apparatus of claim 13, wherein the signal controller is configured to shift the timing of the first data enable signal by a unit of a horizontal period, and wherein the display panel is configured to display an image shifted to the second direction.

15. The display apparatus of claim 13, wherein the signal controller is configured to shift the timing of the first data enable signal by a unit of a pixel period corresponding to one pixel, and wherein the display panel is configured to display an image shifted to the first direction.

16. The display apparatus of claim 13, wherein the signal controller is configured to further generate a data select signal, and wherein the signal generator comprises a multiplexer configured to select one of the input image data and dummy image data based on the data select signal.

17. The display apparatus of claim 16, wherein the display panel is configured to display a black image based on the dummy image data.

18. The display apparatus of claim 13, wherein the signal generator is configured to further generate a memory control signal and a data select signal, wherein the timing controller further comprises a line memory configured to store first input image data during a first duration based on the memory control signal, and wherein the signal generator comprises a multiplexer configured to select one of the input image data and the first input image data based on the data select signal.

19. The display apparatus of claim 18, wherein the first duration corresponds to one of a first horizontal period and a last horizontal period of a first frame.

20. The display apparatus of claim 18, wherein the first duration corresponds to a pixel period during which outermost pixels of a first frame receive image data.

* * * * *